US005884900A

United States Patent [19]

Gobeil et al.

[11] Patent Number: 5,884,900

[45] Date of Patent: Mar. 23, 1999

[54] FASTENER REMOVAL TOOL

[75] Inventors: Richard W. Gobeil, Los Angeles; Robert M. Skidmore, Mission Viejo, both of Calif.

[73] Assignee: McDonnell Douglas Corporation, Hazelwood, Mo.

[21] Appl. No.: 900,168

[22] Filed: Jul. 25, 1997

[51] Int. Cl.[6] ..... B66F 15/00

[52] U.S. Cl. ..... 254/21; 254/25

[58] Field of Search ..... 254/18, 21, 22, 254/19, 25, 27, 26 R, 28

[56] References Cited

U.S. PATENT DOCUMENTS

| | | | |
|---|---|---|---|
| 743,183 | 11/1903 | MIller | 254/25 |
| 743,590 | 11/1903 | Tarbox | 254/25 |
| 830,072 | 9/1906 | Houlihan | 254/25 |
| 870,672 | 11/1907 | Frink et al. | 254/25 |
| 898,568 | 9/1908 | Emmerson | 254/25 |
| 918,219 | 4/1909 | Swan | 254/25 |
| 1,164,776 | 12/1915 | Arbanasin | 254/25 |
| 1,255,660 | 2/1918 | Stevens | 254/25 |
| 1,317,156 | 9/1919 | Diamond . | |
| 1,550,894 | 8/1925 | Erickson . | |
| 2,010,202 | 8/1935 | Santora | 254/25 |
| 2,687,540 | 8/1954 | Noll . | |
| 2,753,150 | 7/1956 | Gibson . | |
| 3,211,240 | 10/1965 | Smitter et al. . | |
| 3,218,030 | 11/1965 | Baro . | |
| 5,695,172 | 12/1997 | Hreha | 254/25 |

FOREIGN PATENT DOCUMENTS

| | | |
|---|---|---|
| 654892 | 4/1929 | France . |

*Primary Examiner*—Robert C. Watson
*Attorney, Agent, or Firm*—Brooks & Kushman P.C.

[57] ABSTRACT

A fastener removal tool includes a substantially planar body portion having first and second ends. A standoff portion extends from the first end. A handle portion extends from the second end. The body portion forms a slot therein for cooperation with the fastener head, whereby the slot may be engaged with the fastener head and the standoff portion used as a fulcrum for removing the fastener. The slot has narrow opposing ends to facilitate engagement with the fastener head as the tool is moved in either longitudinal direction.

15 Claims, 2 Drawing Sheets

Fig. 1
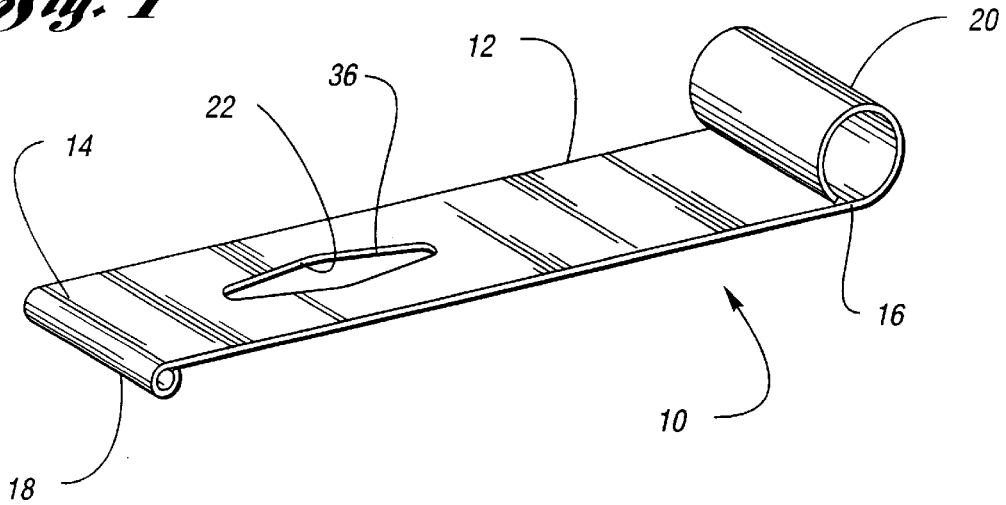
Fig. 2
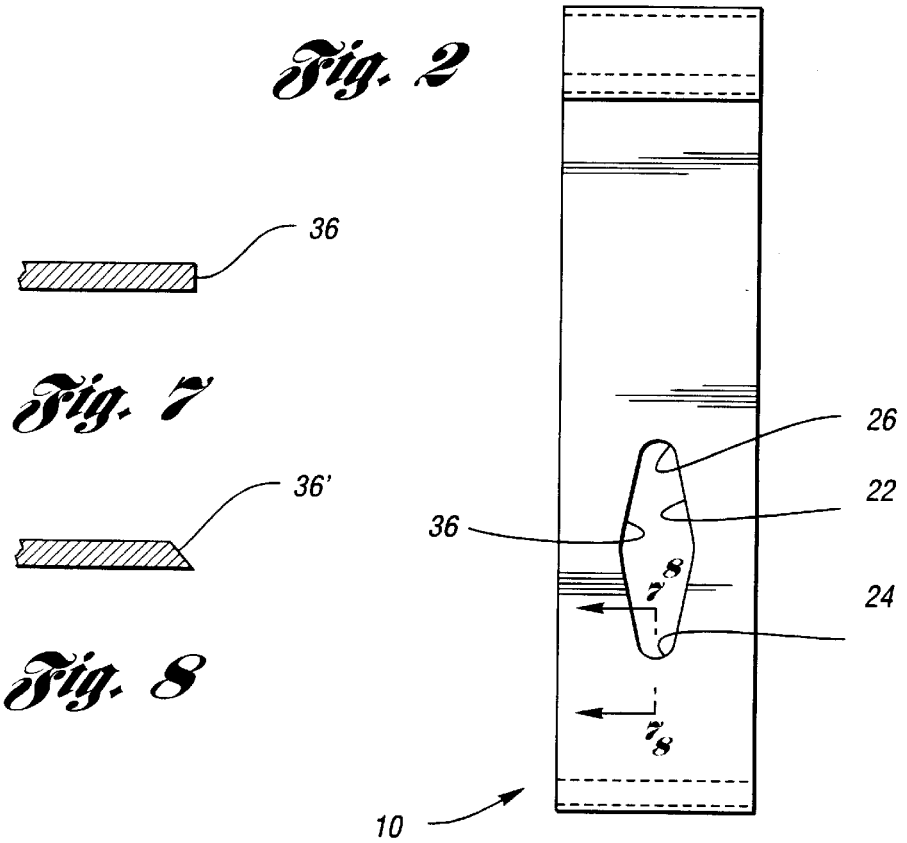
Fig. 7
Fig. 8
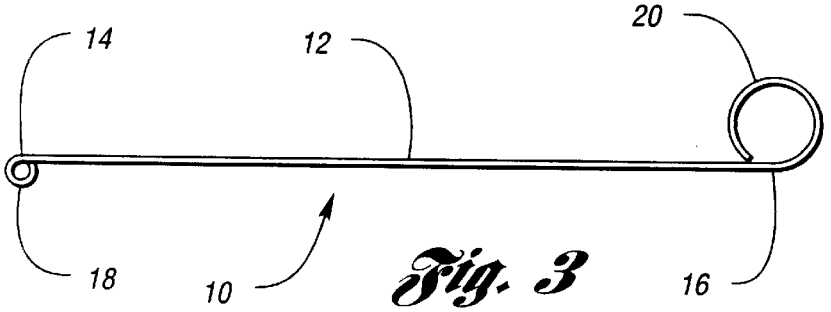
Fig. 3

10
12
18
20
22
30
32
34

FASTENER REMOVAL TOOL

TECHNICAL FIELD

The present invention relates to a fastener removal tool for removing a fastener having a fastener head from a workpiece.

BACKGROUND OF THE INVENTION

Some assembly or disassembly operations require the capability of removing fasteners from difficult to reach locations in the assembly. For example, in an aircraft, snap fasteners are used for securing a liner to an aircraft frame in a cargo area. Such snap-fasteners must sometimes be removed during aircraft servicing without causing damage to the cargo liners or other fragile components, such as composite panels, etc.

Currently available fastener removal tools or nail pullers are incompatible for such an application because the concentrated loading provided by such nail puller designs tends to damage the liner. Also, these prior art nail pullers are often large, and are not designed for fastener removal in tight work spaces.

Accordingly, it is desirable to provide a fastener removal tool which is compatible for use in tight work spaces and which does not provide concentrated loading which would damage an adjacent support surface.

DISCLOSURE OF THE INVENTION

The present invention overcomes the above-referenced shortcomings of prior art fastener removal tools by providing a fastener removal tool having a substantially planar body portion with a slot formed therein for grasping the fastener head, and a standoff portion at one end of the body portion. The standoff portion is used as a fulcrum for removing the fastener. The slot preferably has narrow portions at opposing ends to facilitate engagement with the fastener head as the tool is moved in either longitudinal direction. Accordingly, the tool may be used in tight work spaces, and the standoff portion is sufficiently sized to avoid highly concentrated loading.

More specifically, the present invention provides a tool for removing fasteners having a fastener head from a workpiece. The tool includes a substantially planar body portion having first and second ends. A standoff portion extends from the first end. A handle portion extends from the second end. The body portion forms a slot therein for cooperation with the fastener head, whereby the slot is engageable with the fastener head and the standoff portion is operative as a fulcrum for removing the fastener.

Preferably, the slot is elongated with narrow portions at opposing ends thereof to facilitate engagement with the fastener head as the tool is moved in either of opposing longitudinal directions. Preferably, the body portion is a spring steel material to facilitate flexing for generating a spring force to assist in fastener removal. It is also preferred that the standoff portion and handle portion are rolled extensions of the body portion.

Accordingly, an object of the present invention is to provide a tool for removing fasteners which is functional in tight work spaces and which does not provide highly concentrated surface loading during fastener removal.

Another object of the invention is to provide a fastener removal tool which is partially flexible for generating a spring force to assist in fastener removal.

While embodiments of this invention are illustrated and disclosed, these embodiments should not be construed to limit the claims. It is anticipated that various modifications and alternative designs may be made without departing from the scope of this invention.

BRIEF DESCRIPTION OF THE DRAWINGS

FIG. 1 shows a perspective view of a fastener removal tool in accordance with the present invention;

FIG. 2 shows a plan view of the tool of FIG. 1;

FIG. 3 shows a side view of the tool of FIG. 1;

FIG. 7 shows a cross-sectional view taken along line 7—7 of FIG. 2; and FIG. 8 is a cross-sectional view taken along line 8—8 of FIG. 2 showing an alternative embodiment.

DETAILED DESCRIPTION OF THE PREFERRED EMBODIMENT

Figures 4, 5, 6:
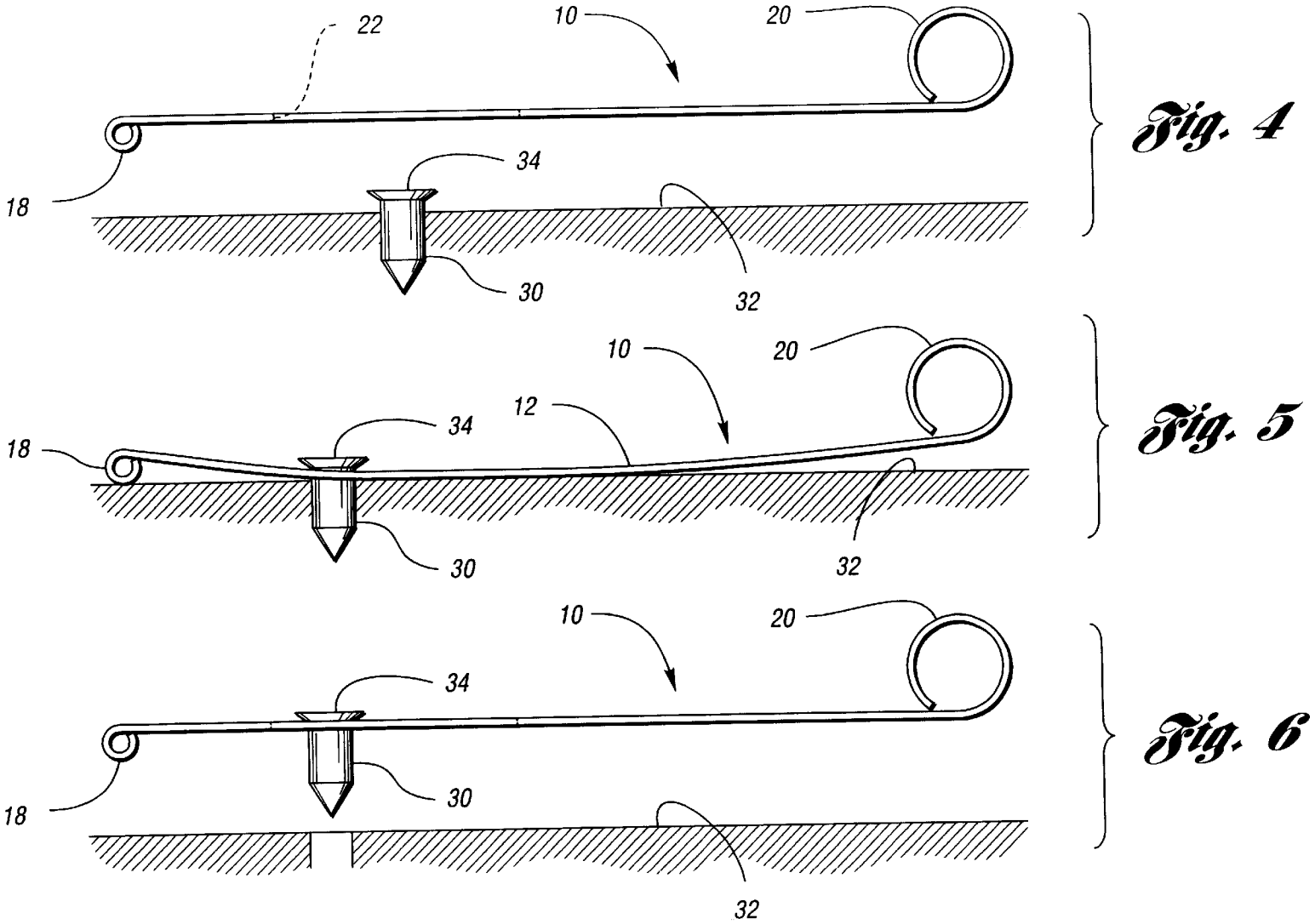
FIG. 4 shows a side view of the tool of the present invention positioned above a fastener to be removed from a work surface.
FIG. 5 shows a side view of the tool of the present invention engaged with a fastener.
FIG. 6 shows a side view of a tool of the present invention after removal of the fastener from the work surface.

Referring to FIGS. 1–3, a fastener removal tool 10 is shown in accordance with the present invention. The fastener removal tool 10 includes a substantially planar body portion 12 having first and second ends 14,16. A standoff portion 18 extends from the first end 14 in a direction away from one side of the plane along which the body portion is disposed. A handle portion 20 extends from the second end 16 in a direction away from the opposing side of the plane along which the body portion 12 is disposed.

The standoff portion 18 and handle portion 20 are preferably rolled extensions of the body portion 12, so as to be generally cylindrical, and extend in generally opposing directions with respect to the planar body portion 12. In the embodiment shown, the rolled extension forming the handle portion 20 has a larger diameter than the rolled extension forming the standoff portion 18. While any variety of diameters could be used, the smaller diameter of the standoff portion 18 allows the tool 10 to be used in limited work spaces.

Of course, the standoff portion 18 and handle portion 20 need not be rolled extensions of the planar body portion 12. The standoff portion 18 and handle portion 20 may comprise any of a variety of structural configurations.

The body portion 12 includes a slot 22 with narrow portions 24,26 at opposing ends of the slot 22. In the embodiment shown, the slot 22 has a generally diamond-shaped configuration. Accordingly, in this configuration, the head of the fastener may be engaged by the narrow portions 24,26 of the slot 22 as the tool 10 is moved either in a first longitudinal direction from the first end 14 toward the second end 16, or in a second longitudinal direction from the second end 16 toward the first end 14. This design facilitates use of the fastener removal tool in tight work spaces because the user may engage the fastener by pulling or pushing the tool along the work surface.

The body portion 12 is preferably a spring steel material, such as carbon steel C-1050 per AMS5085 or ASTM-A-684. The carbon steel is heat-treated after forming and finished with a cadmium plating. The body portion 12 is preferably between approximately 0.015 and approximately 0.025 inches thick.

Turning to FIGS. 4–6, a sequence is illustrated for removal of a fastener 30 from a work surface 32. As shown, the fastener removal tool 10 is positioned over the fastener 30 and lowered to a position in which the head 34 of the fastener 30 is disposed within the slot 22 of the tool 10. Once the fastener removal tool 10 is so positioned relative to a fastener 30, the tool 10 may be moved in either longitudinal direction to facilitate grasping of the head 34 of the fastener 30 within a narrow portion 24,26 of the slot 22.

As illustrated in FIG. 5, the body portion 12 will flex slightly when the handle portion 20 is lifted and the standoff portion 18 engages the work surface 32. Accordingly, such flexing of the body portion 12 of the tool 10 creates a spring force acting upwardly on the head 34 of the fastener 30 to assist in fastener removal. This spring force further facilitates use of the tool 10 in tight work spaces. The handle 20 may then be raised from the work surface 32, and the standoff portion 18 acts as a fulcrum against the work surface 32 in order to assist removal of the fastener 30 from the work surface 32. The standoff portion 18 is provided with a sufficiently elongated surface in order to minimize concentrated loading on the work surface 32 to prevent damage of the work surface 32. Because the standoff portion 18 has a generally cylindrical configuration, any loading will be spread along an identical elongated surface configuration as the tool 10 is used.

The sidewalls 36 of the slot 22 may have any suitable configuration such as perpendicular to the planar body portion 12 as shown in FIG. 7. In an alternative embodiment shown in FIG. 8, the slot 22 may be provided with chamfered sidewalls 36' to facilitate engagement with the head 34 of the fastener 30.

While embodiments of the invention have been illustrated and described, it is not intended that such disclosures illustrate and describe all possible forms of the invention. It is intended that the following claims cover all modifications and alternative designs, and all equivalents, that fall within the spirit and scope of this invention.

What is claimed is:

1. A tool for removing a fastener having a fastener head from a workpiece, the tool comprising:

a substantially planar body portion having first and second ends and first and second opposing sides;

a standoff extending from the first end in a first direction away from said first side;

a handle extending from the second end in a second direction generally opposite said first direction, such that said standoff and said handle are positioned entirely on opposing sides of the planar body portion and only said standoff extends from said first side and only said handle extends from said second side whereby said first side may be laid substantially flat against the workpiece and partially spaced therefrom only by the standoff;

wherein the substantially planar body portion forms a generally diamond-shaped slot therein at a position spaced away from the standoff portion intermediate said first and second ends for cooperation with the fastener head, whereby the slot is engageable with the fastener head and the standoff portion is operative as a fulcrum for removing the fastener from the workpiece; and wherein said planar body portion, standoff and handle are configured from a single component of uniform thickness.

2. The tool of claim 1, wherein the slot is elongated with narrow portions at opposing ends thereof to facilitate engagement with the fastener head.

3. The tool of claim 2 wherein the slot has sidewalls which are generally perpendicular to the planar body portion.

4. The tool of claim 2 wherein the slot has a sidewall which is chamfered.

5. The tool of claim 1, wherein the standoff is a standoff rolled extension of the first end of the body portion and the handle is a handle rolled extension of the second end of the body portion, and the standoff and handle extend in generally opposing directions with respect to the planar body portion.

6. The tool of claim 5 wherein the handle rolled extension has a handle diameter and the standoff rolled extension has a standoff diameter, and the handle diameter is greater than the standoff diameter.

7. The tool of claim 1, wherein the body portion comprises a spring steel material to facilitate flexing of the body portion for generating a spring force to assist in fastener removal.

8. The tool of claim 7, wherein the body portion has a thickness of between approximately 0.015 and approximately 0.025 inches.

9. A tool for removing a fastener having a fastener head from a workpiece, the tool comprising:

a substantially planar body portion having first and second ends and first and second opposing sides;

a standoff portion extending from the first end in a first direction away from said first side, said standoff portion being a rolled extension of the body portion to form a rounded contact surface for engaging the workpiece in a manner to prevent highly concentrated loading of the workpiece during removal;

a handle portion extending from the second end in a second direction generally opposite said first direction, such that said standoff portion and said handle portion are positioned entirely on opposing sides of the planar body portion and only said standoff portion extends from said first side and only said handle portion extends from said second side whereby said first side may be laid substantially flat against the workpiece and partially spaced therefrom only by the standoff portion;

wherein said body portion forms a slot therein at a position spaced away from the standoff portion intermediate said first and second ends for cooperation with the fastener head, whereby the slot is engageable with the fastener head and the standoff portion is operative as a fulcrum for removing the fastener, and wherein the slot is elongated in a generally diamond-shaped configuration with narrow portions at opposing ends to facilitate engagement with the fastener head; and wherein said substantially planar body portion, standoff portion and handle portion are configured from a single component of uniform thickness.

10. The tool of claim 9 wherein the slot has sidewalls which are generally perpendicular to the planar body portion.

11. The tool of claim 9 wherein the slot has a sidewall which is chamfered.

12. The tool of claim 9, wherein the handle portion is a standoff rolled extension of the second end of the body portion, and the standoff portion and handle portion extend in generally opposing directions with respect to the planar body portion.

13. The tool of claim 12 wherein the handle rolled extension has a handle diameter and the standoff rolled extension has a standoff diameter, and the handle diameter is greater than the standoff diameter.

14. The tool of claim 9, wherein the body portion comprises a spring steel material to facilitate flexing of the body portion for generating a spring force to assist in fastener removal.

15. The tool of claim 14, wherein the body portion comprises a thickness of between 0.015 and 0.025 inches.

* * * * *